US009445648B2

(12) United States Patent
Phillips

(10) Patent No.: US 9,445,648 B2
(45) Date of Patent: Sep. 20, 2016

(54) SAFETY SPUR

(71) Applicant: Kathy Phillips, Paw Paw, MI (US)

(72) Inventor: Kathy Phillips, Paw Paw, MI (US)

( * ) Notice: Subject to any disclaimer, the term of this patent is extended or adjusted under 35 U.S.C. 154(b) by 0 days.

(21) Appl. No.: 14/171,043

(22) Filed: Feb. 3, 2014

(65) Prior Publication Data

US 2014/0215978 A1 Aug. 7, 2014

Related U.S. Application Data

(60) Provisional application No. 61/760,721, filed on Feb. 5, 2013.

(51) Int. Cl.

| | |
|---|---|
| ***A43C 17/00*** | (2006.01) |
| ***A43B 3/00*** | (2006.01) |
| *A63B 71/06* | (2006.01) |

(52) U.S. Cl.

CPC ..... *A43C 17/00* (2013.01); *A43B 3/0005* (2013.01); *A63B 2071/0655* (2013.01); *A63B 2220/18* (2013.01); *A63B 2220/80* (2013.01); *A63B 2244/24* (2013.01)

(58) Field of Classification Search

CPC ..... A43C 17/00; A43C 17/02; A43C 17/04; A43C 17/06; A43B 3/0005; A43B 5/00; G08B 21/02; A01L 7/08; A63B 2071/0655; A63B 2220/18; A63B 2220/80; A63B 2244/24

See application file for complete search history.

(56) References Cited

U.S. PATENT DOCUMENTS

| | | | | |
|---|---|---|---|---|
| 2,487,461 | A * | 11/1949 | McKinney | 446/26 |
| 5,826,413 | A | 10/1998 | Bostock et al. | |
| 5,955,667 | A * | 9/1999 | Fyfe | 73/490 |
| 6,122,846 | A * | 9/2000 | Gray | A43B 3/0005 340/573.1 |
| 6,282,872 | B1 | 9/2001 | Schulte | |
| 6,377,178 | B1 * | 4/2002 | DeToro | A61F 5/0111 340/573.1 |
| 7,506,493 | B2 | 3/2009 | Zillmer | |
| 7,526,907 | B2 | 5/2009 | Bostock | |
| 2005/0011169 | A1 | 1/2005 | Zillmer | |
| 2006/0156588 | A1 * | 7/2006 | Ferrell | A43B 3/00 36/136 |
| 2008/0196363 | A1 | 8/2008 | Chang | |
| 2009/0135001 | A1 * | 5/2009 | Yuk | A43B 5/00 340/539.11 |
| 2014/0222173 | A1 * | 8/2014 | Giedwoyn et al. | 700/91 |

FOREIGN PATENT DOCUMENTS

| | | | | |
|---|---|---|---|---|
| TW | 201223598 | * | 6/2012 | A63B 69/00 |

OTHER PUBLICATIONS

Translated abstract of TW 201223598 to Hong et al. dated Jun. 2012.*

* cited by examiner

*Primary Examiner* — Kathleen Alker

(74) *Attorney, Agent, or Firm* — Miller Canfield Paddock and Stone; Mark L Maki

(57) ABSTRACT

This invention provides a safety spur which provides the rider a warning of a potentially dangerous foot position while riding a horse. The spur has a tilt sensor, a radio transmitter, and a radio receiver. Optionally, a 3 axis gyroscope may be used in place of a tilt sensor.

14 Claims, 3 Drawing Sheets

SAFETY SPUR

CROSS REFERENCE TO RELATED APPLICATIONS

This application asserts priority from provisional application 61/760,721, filed on Feb. 5, 2013, which is incorporated herein by reference.

FIELD OF THE INVENTION

This invention provides a safety spur which provides the rider a warning of a potentially dangerous foot position while riding a horse. This allows the rider to adopt a correct foot position and thereby avoid an accident.

BACKGROUND OF THE INVENTION

It is well known that riders, especially inexperienced riders can be unexpectedly thrown from their horse. Being thrown from a horse can often cause severe injury which can be made much worse if the stirrup catches the rider's foot. The rider can often be dragged a considerable distance behind the horse until the horse can be brought to a stop. The importance of this problem is indicated by the number of devices have been suggested which release the riders foot from the stirrup when the rider inadvertently dismounts from the horse.

US Patent Publication 2008/0196363 relates to a stirrup safety structure, which is integrally formed and mainly composed of pedals and inverted U-shaped suspension locking racks. Wherein, appropriate number and shape of troughs are engraved on the pedal to limit the sticking on of mud. Moreover, a stopper ring is respectively set at the prefixed position of the lower section lying in between both ends of the suspension rack; appropriate numbers of movable pulleys are set at the lower rod between said stopper ring and pedal; said movable pulleys have the effect of free rotating. Hence, when a horse-rider falls down from the horseback, said movable pulley can enable the rider to free slip and withdraw his feet from stirrup smoothly, by means of said movable pulley's rubbing and revolving with the rider's feet and the momentum caused by the horse's running, to avoid his feet being hooked by the stirrup. Therefore the present invention can solve the problem of a horse-rider's being dragged along by the horse and get hurt when he falls down from the horseback and, therefore, becomes a simple and effective safety protection device.

US Patent Publication 2005/0011169 provides a safety stirrup (1) comprising an inverted U-shaped mounting member (2) having an adaptation (4) in the arcuate portion of the U for attachment of a stirrup strap thereto, a foot support (3) pivotally mounted between the extremities of the mounting member (2) when the stirrup is in normal use, wherein the foot support (3) comprises a tread (9) having an extension projecting upwardly from each end of the tread (9), the distal ends of which extensions join to form a loop (10). The stirrup also has co-operating engagement means (13, 14) between the foot support (3) and the inverted U-shaped mounting member (2) to retain the loop (10) of said foot support (3) in a plane generally coincident with a central plane of the inverted U-shaped mounting member (2) when the stirrup is in normal use. Rotation of the foot support (3) from the normal in use position disconnects the pivotal mountings (13, 14) and allows separation of the foot support (3) from the mounting member (2).

U.S. Pat. No. 7,526,907 provides a two-way safety stirrup that will release in the event of the rider being dismounted but which is less prone to unexpected release when pressure is applied in the forward direction. The safety stirrups are of far simpler construction than stirrups of the prior art, yet are not as prone to unexpected release and can be made of non-metal materials, such as plastics and polymers, so that the stirrups are more economically manufactured and are of comparatively light weight.

U.S. Pat. No. 7,506,493 provides a safety stirrup (1) comprising an inverted U-shaped mounting member (2) having an adaptation (7) in an arcuate portion (5) thereof for attachment of a stirrup strap thereto, a foot support (3) pivotally mounted between arms (4) of the mounting member (2) when the stirrup (1) is in normal use, wherein the foot support (3) comprises a tread (12) having an extension (13) projecting upwardly from each end of the tread (12), the distal ends of which extensions (13) join to form a loop (14). The stirrup (1) also has co-operating engagement means (25, 26) between the foot support (3) and the mounting member (2) to retain the loop (14) in a plane generally coincident with a central plane of the mounting member (2) when the stirrup (1) is in normal use. Rotation of the foot support (2) from the normal in use position disconnects the pivotal mountings and allows separation of the foot support (3) from the mounting member (2).

U.S. Pat. No. 6,282,872 provides an assist step for a stirrup associated with a saddle wherein the step is secured to or formed integrally with an outer side element of the stirrup which is pivotally mounted at a base of the stirrup such that when pivoted downwardly relative to the base, the step provides a platform for assisting a rider in mounting a saddle. The outer side element also functions as a safety breakaway portion for the stirrup to permit release of a rider's foot in the event a rider falls from the saddle.

U.S. Pat. No. 5,826,413 relates to a safety stirrup for use with horses which prevents a rider's foot from being caught in the stirrup in the event of inadvertent dismounting of the rider. The stirrup consists of a foot support pivotably held within a mounting member. The foot support can be released at an end from the mounting member and portions of the foot support are separable so that a trapped foot can be released.

The devices described above all attempt to prevent the rider's foot from being caught in the stirrup in the event of inadvertent dismounting from the horse. Such dismounting, and especially being thrown from the horse, often results from the rider's poor posture in the stirrups. The existing devices can prevent the injuries caused by dragging, but they cannot prevent the injuries caused by being thrown from the horse in the first place. Accordingly, there is a need for a device to warn the rider of poor posture and prompt corrections so that the entire accident may be avoided and not merely mitigated once it has occurred.

SUMMARY OF THE INVENTION

Riders can get thrown from their horses when their heels get above their toes. Putting the heels above the toes pushes the bottom of the stirrup to backwards and raises the rider's center of gravity. It also pushes the feet deeper into the stirrup increasing the chance that the rider will be thrown from the horse and that his foot will get caught in the stirrup. Raising the heels above the toes also causes the rider's leg to tilt. The present invention provides for a sensor in a spur, which the rider wears, to detect when a rider tilts his leg by placing his heels higher than his toes. When the rider tilts his leg by placing his heels higher than his toes, the sensor senses the tilt of his leg and a radio transmitter in the spur transmits a warning to a radio receiver carried by the rider. In response to the warning the rider can adjust his feet in the stirrup and therefore be less likely to fall off the horse, or be thrown from the horse. When the rider adjusts his feet he will pull them back so that they are not as deep in the stirrup and thus the rider is less likely to have a foot stuck in a stirrup if he is thrown from the horse. Thus, the device helps to avoid the accident of getting thrown off the horse and lessens the seriousness of the accident if the rider is thrown.

DETAILED DESCRIPTION OF THE INVENTION

Figure 1:
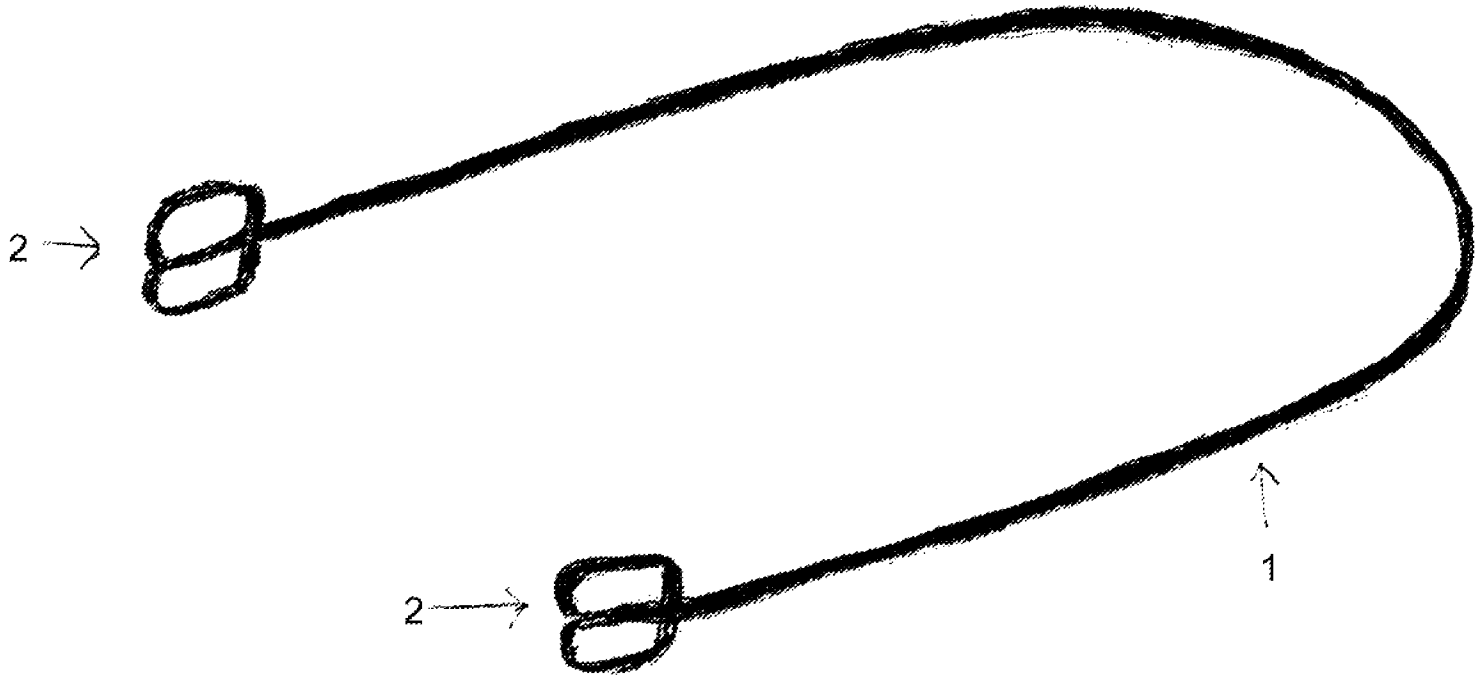
FIG. 1 shows a reinforcing structure within the spur.

FIG. 1 shows a reinforcing structure within the spur. The reinforcing structure (1) ends in buckles 2.

Figure 2:
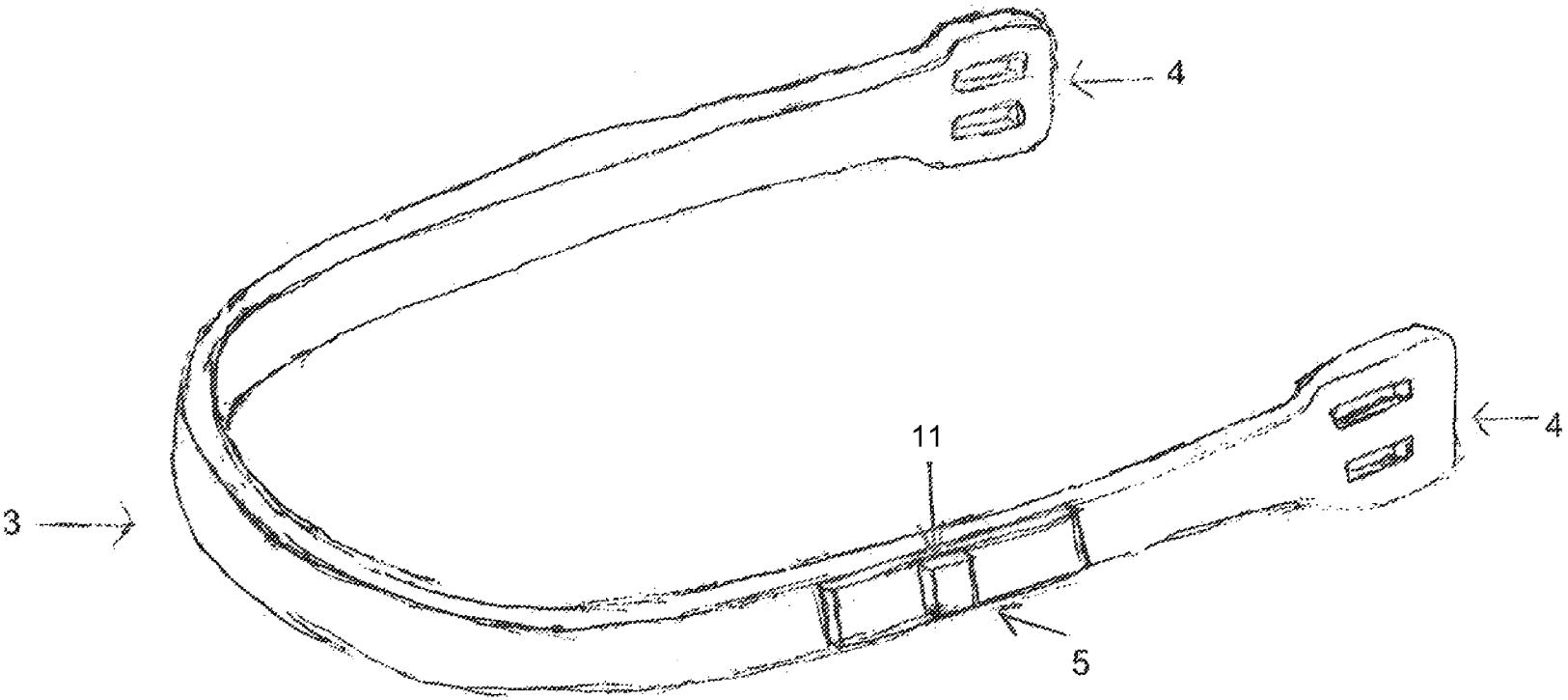
FIG. 2 shows the complete spur.

FIG. 2 shows the complete spur (3). The spur (3) has a strap buckle (4) at each end. Along a side of the spur (3) there is a sensor (5) to detect the position of the rider's leg. The reinforcing structure within the spur (3) is not shown. The radio transmitter (11) is included in the tilt sensor assembly with the sensor 5.

Figure 3:
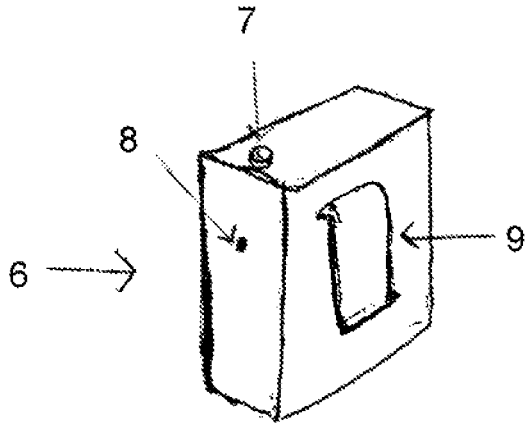
FIG. 3 shows a radio receiver which is worn by the rider.

FIG. 3 shows a radio receiver (6) which is worn by the rider. The receiver (6) has an antenna (7), an ear phone output (8) and a clip (9). A battery inside the receiver (3) is not shown.

The spur can be made from a variety of plastic materials. The plastic is thermoplastic so that spur remains flexible and can be readily placed around the rider's boot and tightened using a strap. Optionally, the spur may have a metal reinforcing structure within the plastic spur. If the spur has a reinforcing metal structure, it may be made from a more bendable material such as polyurethane, polyethylene, polypropylene, natural rubber, synthetic rubber, and silicones. A polyurethane casting resin manufactured by the Alumilite corporation is a preferred material. The spur may be made with an end which will accommodate a strap to hold it on the rider's boot, or an actual corrective spur. Only riders, who are qualified, should ride with an actual corrective spur.

The plastic spur may be reinforced with a reinforcing structure. This makes the spur stiffer, and increases durability. The reinforcing structure (1) can be made of a variety of materials. For example, the reinforcing structure could be made from spring or non-spring steels including stainless steels. The structure could be made from low iron alloys such as the inconel alloys or hasteloy. The structure could be made from non-ferrous alloys such as phosphor bronze, beryllium copper, or monel metal. Mild steel is preferred because it has sufficient strength and is inexpensive. The reinforcing structure can quite variable in shape. For example it can be a single wire, a braided wire, or be a flat ribbon of sheet metal. The preferred shape is a wire. However a flat sheet metal piece, which can be bent in the proper shape around the rider's boot, may be used. 16 to 18 gauge wire or 16 to 18 gauge sheet metal are preferred.

The sensor (5) to detect the position of the rider's leg is able to detect if a rider has tilted his leg by placing his heel higher than his toes. The sensor (5) could be a tilt sensor or a small 3 axis gyroscope. A tilt sensor is a small battery powered device which can be readily attached to the spur. There a number of suitable tilt sensors on the market including sensors manufactured by C&K Components, ROHM Industries, NKK Switches, and Parallax. The tilt sensor has a small short range radio transmitter, with a range of about 6 feet operating at either 315 mhz or 433 mhz. This assures that if the riders stay a reasonable distance apart, such as 15 feet, there will be no interference between the transmitter of one rider and the receiver of another rider.

Alternatively, the spur (3) could contain a small 3 axis gyroscope. The gyroscope can detect motions in three axes and thus provides the opportunity to get more information about the orientation of the rider's foot. Thus, if the rider rotates his boot from side to side this could be detected by the three axis gyroscope but not by a simple tilt sensor. Small 3 axis gyroscopes powered by a replaceable battery are commercially available for example from Murata Electronics, or ST Micro Electronics.

The receiver or receiver unit (6) is a small battery operated unit which may be worn on the rider's clothing or may be kept in a pocket. The size of the receiver unit (6) may vary as long as the unit is big enough that the user will not lose it easily, and small enough to fit in a pocket. The unit may be from 1.5 to 4 inches tall and 1 to 3 inches wide. The unit has a clip (9) which allows the unit (6) to be attached to the rider's clothing. Alternatively the rider may keep the unit loose in a pocket. The device may have a vibrator alarm, similar to that used on a cellular telephone. When the alarm is activated the rider can feel the vibrations. Alternatively, the receiver (6) may have an audio alarm which the rider can hear when the device is activated. The audio alarm may go through the ear phone output (8) to an ear phone being worn by the user. The receiver (6) has the clip (9) which allows it to be attached to the rider's belt. When worn on the belt it is possible that the rider may not feel a vibratory warning. In that case the audio alarm, either loud enough to be heard while the receiver (6) is being worn on the riders belt, or heard through an ear phone, would be used.

The present device provides a warning if the rider riding with his or her heels above the toes. Putting the heels pushes the bottom of the stirrup back and pushes the rider's foot deeper into the stirrup. In this position it is more likely that the rider will fall off or be thrown from the horse, and if he is, he is more likely to have his foot caught in the stirrup and can be dragged by the horse. The device is able to detect that the heels are above the toes because when the heels are lifted above the toes the tilt sensor senses this tilt and a transmitter transmits a warning to a device carried by the rider. It provides an audible warning so that the rider becomes aware of the problem and adjusts his or her posture so that the heels and toes are even in the stirrup or the heels are slightly below the toes. This is important putting the heels even or slightly below the toes lowers the rider's center of gravity and decreases the chance that the rider will get thrown from their horse. Riding this way also lessens the chances that a rider's foot will get caught in the stirrup if the rider is thrown from the horse.

Example I

A spur 10 inches long from end to end was built. The body of the spur was made from an Alumilite polyurethane resin. The reinforcing structure was a 17 gauge wire that was approximately 14 inches long. The reinforcing wire was molded into a square spur strap buckle at each end. The spur band was approximately 1½" wide. The spur contained a tilt sensor, which detects the angle of the rider's foot. The spur had a Linx Technologies transmitter operating at 433 megahertz, and a 12 volt battery. The round 17 gauge wire, the tilt sensor, the battery, and the transmitter were encased within the body of the spur. The battery in the spur may be accessed by removing a cover which is attached to the spur. The receiver and electronic audible indicator were contained within a plastic box. The plastic box was approximately 3×3×1½ inches in dimension. The box had a metal plastic clip which could be clipped to the rider's clothing. Within the receiver box there was a 9 volt battery which powers the receiver.

The invention claimed is:

1. A safety spur comprising:

a spur portion which is attachable to a leg of a rider, said spur portion including a sensor to sense a position of a rider's leg in both a correct foot position and an incorrect foot position in a stirrup, and a radio transmitter communicating with said sensor and transmitting a warning when said sensor senses that a foot of the rider has moved to said incorrect foot position within the stirrup, and a radio receiver being provided which is wearable by the rider at a location separate from said spur portion and said transmitter, wherein said radio receiver receives said warning transmitted by said transmitter, said radio receiver including and communicating with an alarm which generates an alarm signal detectable by the rider to prompt the rider to correct the position of the rider's foot from said incorrect foot position to said correct foot position.

2. A safety spur according to claim 1 in which the sensor to sense the position of the rider's leg comprises a tilt sensor.

3. A safety spur according to claim 1 in which the sensor to sense the position of the rider's leg comprises a gyroscope.

4. A safety spur according to claim 1 in which said spur portion comprises a resin material and a metal reinforcing structure.

5. A safety spur according to claim 4 in which the resin material is a polyurethane casting resin.

6. A safety spur according to claim 4 in which the metal reinforcing structure is a wire.

7. A safety spur according to claim 4 in which the metal reinforcing structure is sheet metal.

8. A safety spur comprising:

a spur portion which is attachable to a leg of a rider having a foot positionable in a stirrup, said spur portion including a sensor to sense a position of a rider's foot within the stirrup in both a correct foot position and an incorrect foot position;

a radio transmitter disposed in said spur portion, said radio transmitter communicating with said sensor and transmitting a warning via a radio transmission when said sensor senses that the foot of the rider has moved to said incorrect foot position;

a radio receiver which is wearable by the rider at a location separate from said spur portion and receives radio transmissions, said radio receiver receiving any said warning transmitted by said transmitter, and said radio receiver including an alarm, wherein said radio receiver actuates said alarm when said receiver receives said warning from said transmitter, wherein said alarm is detectable by the rider to indicate that the foot of the rider is in said incorrect foot position and prompt the rider to reposition the rider's foot from said incorrect foot position to said correct foot position.

9. A safety spur according to claim 8, wherein said sensor comprises a tilt sensor which detects a tilt angle of a foot of the rider as defined between a toe and a heel of the foot.

10. A safety spur according to claim 9, wherein said sensor is wearable on the side of said spur portion which is wearable along a side of a foot.

11. A safety spur according to claim 8, wherein said sensor comprises a gyroscope which detects motions in three axes and detects a tilt angle of the foot of the rider as defined between a toe and a heel of the foot, and detects rotation of the foot from side to side.

12. A safety spur according to claim 11, wherein said sensor is wearable on a side of said spur portion which is wearable along a side of the foot.

13. A safety spur according to claim 8, wherein said incorrect foot position is defined by a heel of the foot of a rider being vertically higher than the toe of the foot in a stirrup, which is detected by said sensor, and said correct foot position is defined by a heel of the foot of the rider being vertically even with or lower than the toe of the foot in the stirrup, which is detected by said sensor.

14. A safety spur according to claim 8, wherein said spur portion includes buckles for attaching said spur portion to the foot of the rider.

* * * * *